US005714922A

United States Patent [19]

Suzuki et al.

[11] Patent Number: 5,714,922

[45] Date of Patent: Feb. 3, 1998

[54] IGNITION COIL FOR AN INTERNAL COMBUSTION ENGINE

[75] Inventors: Toshiro Suzuki, Nissin; Makoto Mase, Handa; Hitoshi Takeuchi, Chita, all of Japan

[73] Assignee: Aisan Kogyo Kabushiki Kaisha, Obu, Japan

[21] Appl. No.: 505,390

[22] Filed: Jul. 21, 1995

[30] Foreign Application Priority Data

Jul. 26, 1994 [JP] Japan ..... 6-194899

[51] Int. Cl.[6] ..... H01F 17/00; H01F 27/04; H01F 27/29; F02P 11/00

[52] U.S. Cl. ..... 336/107; 336/105; 336/92; 336/192; 123/634

[58] Field of Search ..... 336/107, 90, 92, 336/105, 192, 181–182; 123/634, 635

[56] References Cited

U.S. PATENT DOCUMENTS 5,041,807 8/1991 Badaud ..... 336/92
5,170,767 12/1992 Wada et al. ..... 123/633
5,394,302 2/1995 Trautwein et al. ..... 336/192

FOREIGN PATENT DOCUMENTS 4125-552 1/1991 European Pat. Off. ..... 123/634
3-257908 11/1991 Japan .
2199193 6/1988 United Kingdom ..... H01F 27/24

*Primary Examiner*—Michael L. Gellner
*Assistant Examiner*—Anh Mai
*Attorney, Agent, or Firm*—Oliff & Berridge, P.L.C.

[57] ABSTRACT

The invention is directed to an ignition coil for use in an internal combustion engine. The ignition coil includes a core and a bobbin in which at least a part of the core is received. Primary and secondary windings are wound around the bobbin. A secondary terminal is mounted on the bobbin, and a high-tension terminal is mounted on a housing. The secondary terminal is formed in a Y-letter shape with its body portion and a pair of leg portions. The high-tension terminal is formed with a recess, in which the leg portions of the secondary terminal are received. Each of the leg portions has a projection which is biased to contact with the inner surface of the recess.

5 Claims, 3 Drawing Sheets

IGNITION COIL FOR AN INTERNAL COMBUSTION ENGINE

BACKGROUND OF THE INVENTION

1. Field of the Invention

The present invention relates to an ignition coil for an internal combustion engine, and more particularly to an ignition coil having a housing which accommodates a primary winding and a secondary winding wound around a core.

2. Description of the Related Art

A conventional ignition coil for an internal combustion engine is provided with a primary winding and a secondary winding which are wound around a core respectively. The primary winding is electrically connected to a control circuit for controlling a primary current, and the secondary winding is electrically connected to an ignition plug through a high-tension terminal. That is, the opposite ends of the wire of the primary winding are electrically connected to a pair of primary terminals, respectively, while one end of the wire of the secondary winding is electrically connected to the primary terminal and the other end is electrically connected to the high-tension terminal.

As for the ignition coil for the internal combustion engine as described above, it has been proposed in Japanese Patent Laid-open Publication No. 3-257908 that a terminal of a secondary winding for connecting to a high-tension terminal is divided into an auxiliary terminal, which is mounted on a collar of a bobbin, and a secondary terminal which is assembled with the auxiliary terminal after the secondary winding was wound around the bobbin, so that an end portion of the secondary winding may be connected with the auxiliary terminal after the secondary winding was wound by an automatic winding machine. It is stated in the publication that the secondary terminal was to be assembled after the winding operation according to the prior ignition coil, so that it was impossible to automatically connect the end portion of the secondary winding with the secondary terminal by the automatic winding machine, and therefore, the object in the publication was to automate the winding operation.

According to the ignition coil as proposed in the above publication, however, a high-tension output circuit is so constituted that the secondary coil is connected to the high-tension terminal through the auxiliary terminal and the secondary terminal (and furthermore a resistor). Therefore, not only the structure would be complicated, but also the coil is increased in cost due to increase of the number of parts, thereby to countervail the merit obtained by automating the winding operation. As shown in FIG. 3 (A) of the above publication, the secondary terminal is formed at the opposite ends thereof with edge portions, so that the edge portions expose in a housing, as shown in FIG. 2 of the publication, when the secondary terminal is assembled in the housing. Therefore, the electric field is likely focused on the edge portions of the secondary terminal, so that a high tension might be leaked out therefrom. As a countermeasure against this, if the dimensions of various parts are determined so as to ensure a withstand voltage, the ignition coil as a whole becomes large in size, which will cause another problem.

SUMMARY OF THE INVENTION

It is, therefore, an object of the present invention to provide an ignition coil for an internal combustion engine, wherein a secondary terminal may be electrically connected to a high-tension terminal easily and effectively, with as small number of parts as possible.

It is another object of the present invention to provide an ignition coil having a structure for preventing a high-tension leak from being caused at a portion connected to a high-tension terminal.

In accomplishing the above and other objects, an ignition coil for an internal combustion engine includes a core, and a bobbin having a cylindrical portion which receives therein at least a part of the core. A primary winding and a secondary winding are wound around the bobbin. A secondary terminal is provided with a body portion which is mounted on the bobbin to electrically connect with the secondary winding, and a pair of leg portion which extend from the body portion to form a Y-letter shape. A housing is provided for accommodating therein the bobbin which is associated with the core, the primary winding, the secondary winding and the secondary terminal. And, a high-tension terminal is mounted on the housing. The high-tension terminal is formed with a recess for receiving therein at least the leg portions of the secondary terminal, with the leg portions biased to contact with an inner surface of the recess.

In the above-described ignition coil, the secondary terminal preferably includes a projection which is formed on each of the leg portions, and which extends perpendicularly to the axis of each leg portion and opposite to the other projection.

The secondary terminal may be formed with a Y-letter shaped conductive plate, and each projection may be provided with a curved surface to contact with the inner surface of the recess.

Furthermore, it is preferable that the width between the leg portions at the positions thereof formed with each projection is greater in the free conditions of the leg portions than the inner diameter of the recess at the position thereof contacted with the projection, so that the leg portions are biased to force each projection contact with the inner surface of the recess, when the leg portions are accommodated in the recess.

Preferably, the recess of the high-tension terminal may be formed to provide an opening having a curved surface along the periphery of the opening.

BRIEF DESCRIPTION OF THE DRAWINGS

The above stated objects and following description will become readily apparent with reference to the accompanying drawings, wherein like reference numerals denote like elements, and in which.

DESCRIPTION OF THE PREFERRED EMBODIMENT

Figure 4:
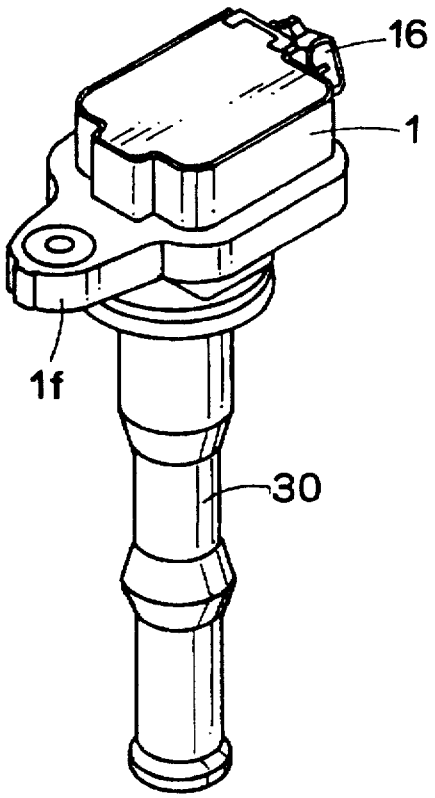
FIG. 4 is a perspective view of an ignition coil according to an embodiment of the present invention.
Figure 5:
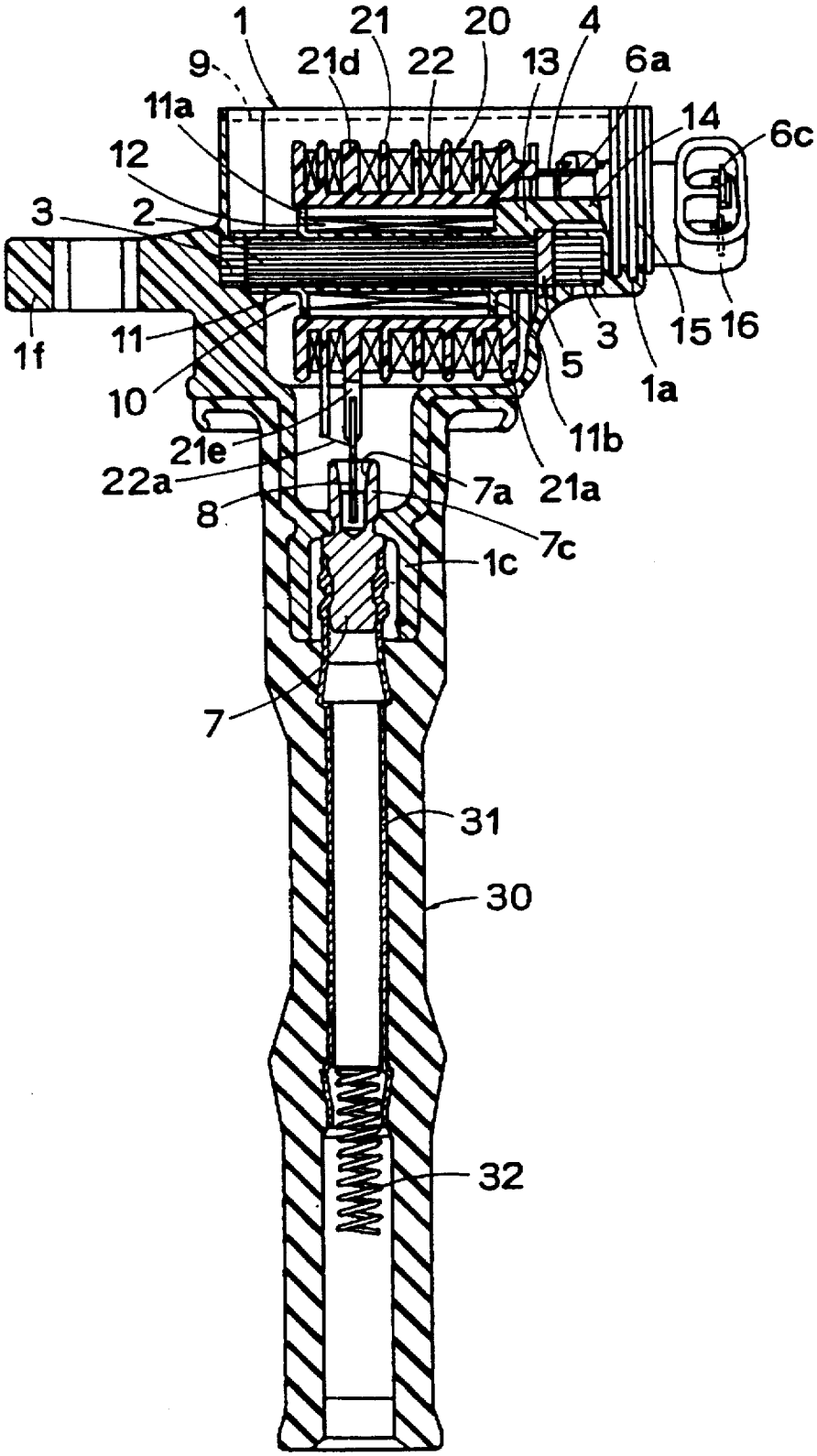
FIG. 5 is a sectional view of an ignition coil according to an embodiment of the present invention.

Referring to FIG. 4, there is illustrated an overall structure of an ignition coil according to an embodiment of the present invention. An ignition coil has a box-like housing 1 and a columnar plug cap 30 connected thereto. In the housing 1, cores 2 and 3 are accommodated to constitute a magnetic path approximate to a B-letter shape on a horizontal plane (i.e., a plane which is perpendicular to the vertical plane as shown in FIG. 5). The core 2 is accommodated in a primary coil assembly 10 and a secondary coil assembly 20, while the core 3 is provided for encircling these assemblies.

Figure 3:
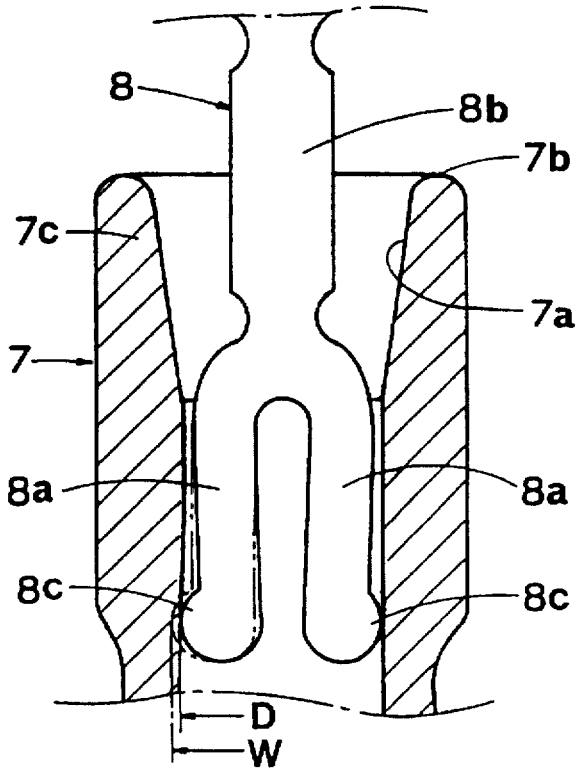
FIG. 3 is an enlarged sectional front view of a structure connecting a secondary terminal to a high-tension terminal of an ignition coil according to an embodiment of the present invention.

The housing 1 is made of synthetic resin to form a box as shown in FIG. 5, and mold therein the core 3 to define inside thereof a space for receiving the primary coil assembly 10 and the secondary coil assembly 20. The top of the housing 1 opens, and at one side thereof, there is provided an opening 1*a* for receiving a support portion 15 of the primary coil assembly 10 fitted into the opening 1*a*, while at the other side of the housing 1, a flange portion 1*f* extends therefrom. At the bottom of the housing 1, there is formed a connecting portion 1*c*, in which a high-tension terminal 7 is accommodated. The high-tension terminal 7 is provided with a cylindrical portion 7*c* which is made in the form of a cylinder with a bottom to define a recess, or a hollow portion 7*a* having a tapered inner surface and a cylindrical inner surface. An opening peripheral portion 7*b* of the high-tension terminal 7 is formed to provide a curved surface as shown in FIG. 3.

The connecting portion 1*c* is called as a high-tension tower, onto which one opening end of the plug cap 30 is fitted. The plug cap 30 has a connecting terminal 31 covered by an insulating material such as rubber or the like for withstanding the high tension, and formed with recesses at its opposite ends. One opening end of the plug cap 30 is connected to the connecting portion 1*c* to be integral with the housing 1, and the other opening end is adapted to be connected to an ignition plug (not shown). In the recess connected to the ignition plug, a conductive spring 32 is accommodated and electrically connected with the connecting terminal 31. The core 3 which is accommodated in the housing 1 is constituted by non-oriented silicon steel plates stacked one on the other in the form of a rectangular ring member, for example, while it may be constituted by grain oriented silicon steel plates. On the other hand, the core 2 is formed in a T-letter shape by grain oriented silicon steel plates which are rolled in its axial direction and stacked one on the other.

The primary coil assembly 10 includes a primary bobbin 11, a holding portion 13, a connecting portion 14, a support portion 15 and a connector 16, which are made of synthetic resin, with the core 2, a pair of primary terminals (represented by 6*a*) and a pair of connector terminals (represented by 6*c*) accommodated integrally by insert-molding. The primary bobbin 11 is formed to integrally accommodate a main body of the core 2, and formed at its opposite ends with collars 11*a* and 11*b* having an approximately rectangular cross section, respectively, which are fitted into the central hollow portion of a secondary bobbin 21 which will be described later. On the primary bobbin 11, a primary winding 12 is mounted with its wire wound around the primary bobbin 11 between the collars 11*a* and 11*b* to provide two or four layers. The both ends of the primary winding 12 are connected to the respective primary terminals 6*a* and soldered on the connected portions. One of the connector terminals 6*c* is connected to a battery (not shown) and the other one of the connector terminals 6*c* is connected to a control circuit, or a so-called igniter (not shown).

The holding portion 13 extends from the primary bobbin 11 to hold a permanent magnet 5 in contact with the core 2. The permanent magnet 5 is disposed to provide a magnetic flux in the direction opposite to the direction of the magnetic flux which is produced in the cores 2, 3, when the primary winding 12 is fed with the electric current. As for the permanent magnet 5, preferably employed is a rare earth magnet of a sintered metal such as samarium-cobalt (SmCo), which has a large residual magnetic flux density and a property to be hardly demagnetized, while a neodymium magnet may be employed. The holding portion 13 is connected with the support portion 15 through the connecting portion 14, on which the primary terminals 6*a* are embedded, and the support portion 15 is connected with the connector 16, in which the connector terminals 6*c* are accommodated. Conductors (not shown) for electrically connecting the primary terminals 6*a* with the connector terminals 6*c* are embedded in the connecting portion 14, support portion 15 and connector 16.

Figure 1:
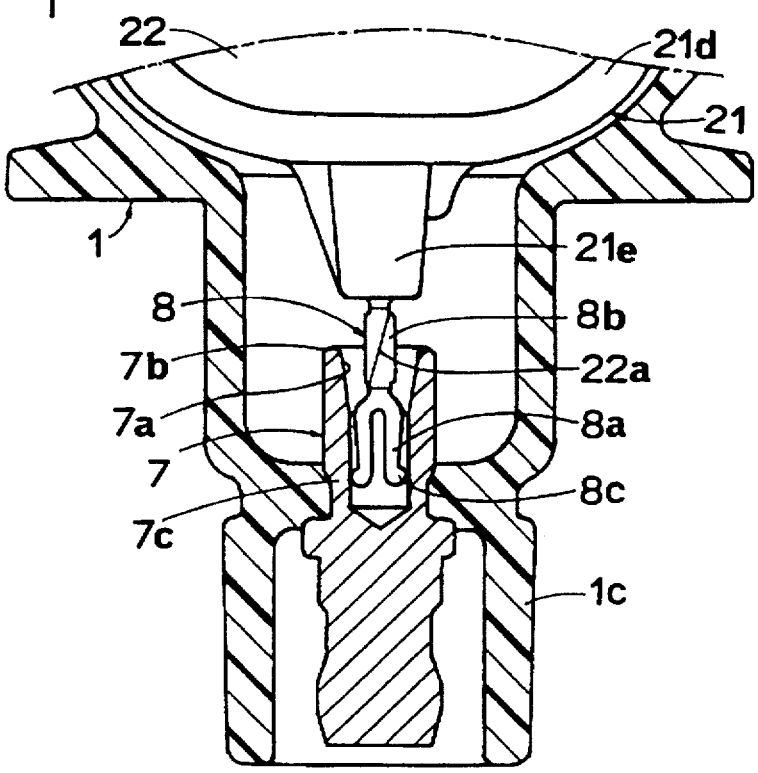
FIG. 1 is an enlarged sectional front view of a part of an ignition coil according to an embodiment of the present invention.
Figure 2:
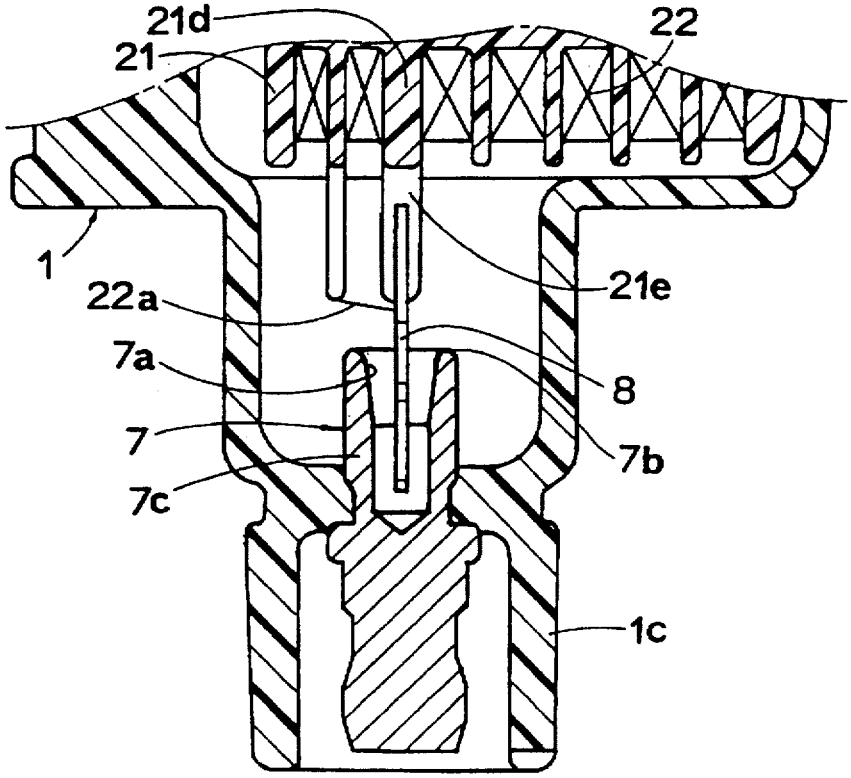
FIG. 2 is an enlarged sectional side view of a part of an ignition coil according to an embodiment of the present invention.

The secondary coil assembly 20 includes the secondary bobbin 21 and a secondary winding 22 wound thereon. The secondary bobbin 21 is made of synthetic resin and formed in a cylinder of an approximately rectangular cross section, on which a plurality of collars (represented by 21*a*) are formed with a certain space between adjacent two of the collars 21*a* along the axis of the secondary bobbin 21. The wire of the secondary winding 22 is wound in each space between the collars 21*a*. A collar 21*d*, one of the collars 21*a*, is formed to have a relatively broad width, and a protruded portion 21*e* extends from the collar 21*d*, on the tip end of which a secondary terminal 8 is secured. The primary bobbin 11 of the primary coil assembly 10 is fitted into the hollow portion of the secondary bobbin 21, so that the primary bobbin 11 is supported at the opposite ends thereof by the secondary bobbin 21 to prevent the relative movement in the axial direction and in the direction perpendicular thereto between the primary bobbin 11 and the secondary bobbin 21. The cross sections of the primary bobbin 11 and secondary bobbin 21 may be formed in a circular shape or the like other than the rectangular shape. On one of the collars 21*a* formed at an end of the secondary bobbin 21, there is mounted an auxiliary terminal 4 which is connected to one of the primary terminals 6*a* via a diode (not shown), and to which one end of the wire of the secondary winding 22 is connected and soldered. The other end 22*a* of the wire of the secondary winding 22 is connected to the secondary terminal 8 as shown in FIGS. 1, 2 and 5, and soldered.

The secondary terminal 8 is made of elastic conductive material such as phospher bronze or the like and stamped into a plate of a Y-letter shape, which has a body portion 8*b* and a pair of leg portions 8*a*, 8*a* extending therefrom in approximately parallel with each other. The body portion 8*b* is secured to the protruded portion 21*e* of the secondary bobbin 21 as shown in FIGS. 1 and 2, with the leg portions 8*a*, 8*a* extending outwardly and perpendicularly to the axis of the secondary bobbin 21. Therefore, when the secondary coil assembly 20 is assembled into the housing 1, the leg portions 8*a*, 8*a* are pressed into the hollow portion 7*a* of the high-tension terminal 7. As shown in FIG. 3, on each tip end portion of the leg portions 8*a*, 8*a*, there is formed a projection 8*c* respectively, outer side surface of which is biased to contact with the inner surface of the hollow portion 7*a*, and may be formed in a curved surface. That is, the secondary terminal 8 is so designed that the width (as indicated by "W" in FIG. 3) between the leg portions 8*a*, 8*a* at the positions thereof formed with each projection 8*c* is greater in their free conditions than the inner diameter (as indicated by "D" in FIG. 3) of the narrowest portion in the hollow portion 7*a* of the high-tension terminal 7. In the case where the secondary terminal 8 is pressed into the hollow portion 7*a*, therefore, the secondary terminal 8 is engaged with the inner surface of the hollow portion 7*a*, so that the width between the leg portions 8*a*, 8*a* is shortened. That is, the leg portions 8*a*, 8*a* are displaced as shown in FIG. 3, from a position indicated by a double-dashed chain line to a position indicated by a solid line. As a result, the outer side surface of the projection 8*c* of the secondary terminal 8 is pressed by its biasing force onto the inner surface of the hollow portion 7*a* of the high-tension terminal 7. The projection 8*c* may be formed in any shapes other than the curved shape as shown in FIG. 3.

In the case where the above-described ignition coil is assembled, the secondary coil assembly 20 is assembled into the primary coil assembly 10, and various terminals in these assemblies are connected and soldered. That is, the soldering of the terminals is made before these assemblies are accommodated in the housing 1. When the primary coil assembly 10 and secondary coil assembly 20 are received in the housing 1, the leg portions 8*a*, 8*a* (FIG. 1) of the secondary terminal 8 are pressed into the hollow portion 7*a* of the high-tension terminal 7, the support portion 15 of the primary coil assembly 10 is fitted into the opening 1*a* of the housing 1, and both the core 2 and the permanent magnet 5 are fitted into the inside of the core 3. Then, a thermosetting synthetic resin such as epoxy resin is filled in the housing 1 and set to form a molded resin 9 (whose top surface is indicated by a phantom line in FIG. 5). Thus, the primary and secondary windings 12, 22 are impregnated and made rigid with such resin, and the insulation is ensured to endure the high-tension output from the secondary winding 22. According to the ignition coil as structured above, the permanent magnet 5 has its N pole at the right side in FIG. 5, for example, and provides a closed loop of magnetic flux in the cores 2, 3.

In operation, when the primary current is fed to the primary winding 12 through the control circuit (not shown), the magnetic flux is produced in a direction opposite to the magnetized direction by the permanent magnet 5. Then, when the primary current is cut off, a counter electromotive force is induced in the secondary winding 22, so that such a high tension as 30 to 40 kilovolts is output from the secondary winding 22. This high tension is fed to the ignition plug (not shown) through the secondary terminal 8, the high-tension terminal 7, the connecting terminal 31 and the spring 32, so that a spark discharge is caused at an electrode of the ignition plug (not shown) to ignite a compressed air-fuel mixture in a combustion chamber (not shown).

According to the present embodiment, the secondary terminal 8 is formed in the plate which has edge portions, on which the electric field might be focused. However, most part of the secondary terminal 8 is placed in the hollow portion 7*a* of the high-tension terminal 7, with the leg portions 8*a*, 8*a* accommodated in the hollow portion 7*a*, only a small part of the body portion 8*b* exposes in the housing 1, so that the high tension is effectively prevented from being leaked out. Furthermore, the opening peripheral portion 7*b* of the high-tension terminal 7, which is placed at the outermost position and which corresponds to the edge portion in the prior art, is formed to provide the curved surface without any edge portion, so that the electric field will be hardly focused on the high-tension terminal 7, and therefore the leak of the high tension can be avoided.

It should be apparent to one skilled in the art that the above-described embodiment is merely illustrative of but one of the many possible specific embodiments of the present invention. Numerous and various other arrangements can be readily devised by those skilled in the art without departing from the spirit and scope of the invention as defined in the following claims.

What is claimed is:

1. An ignition coil for an internal combustion engine comprising:

a core;

a bobbin having a cylindrical portion for receiving therein at least a part of said core;

a primary winding and a secondary winding wound around said bobbin;

a secondary terminal having a body portion mounted on said bobbin for electrically connecting with said secondary winding, and a pair of leg portions extending from said body portion to form a Y-letter shape;

a housing for accommodating therein said bobbin, said core, said primary winding, said secondary winding and said secondary terminal; and a high-tension terminal mounted on said housing and having a recess for receiving therein at least said leg portions of said secondary terminal, with said leg portions biased to contact with an inner surface of said recess.

2. The ignition coil for an internal combustion engine as set forth in claim 1, wherein said secondary terminal includes projections formed on said leg portions, respectively, said projections extending perpendicularly to axes of said leg portions and opposite to each other.

3. The ignition coil for an internal combustion engine as set forth in claim 2, wherein said secondary terminal is a conductive plate having said body portion and said leg portions to form the Y-letter shape, and wherein each projection has a curved surface to contact with the inner surface of said recess.

4. The ignition coil for an internal combustion engine as set forth in claim 3, where a width between said leg portions at positions thereof having the projections, respectively, is greater in free conditions of said leg portions than an inner diameter of said recess at a position thereof contacted with said projections, said leg portions being biased to force said projections in contact with the inner surface of said recess, with said leg portions accommodated in said recess.

5. The ignition coil for an internal combustion engine as set forth in claim 1, wherein said said high-tension terminal provides an opening having a curved surface along a periphery of said opening.

* * * * *